United States Patent [19]

Erdman

[11] 4,186,444

[45] Feb. 5, 1980

[54] COAT SLEEVE FORM

[76] Inventor: John F. Erdman, R.D. #2, Quakertown, Pa. 18951

[21] Appl. No.: 889,875

[22] Filed: Mar. 24, 1978

[51] Int. Cl.[2] ..... D06C 5/00

[52] U.S. Cl. ..... 223/72; 2/74; 285/397

[58] Field of Search ..... 223/61, 63, 65, 70, 223/72–74; 24/38; 285/22, 397; 38/141

[56] References Cited

U.S. PATENT DOCUMENTS

| | | | |
|---|---|---|---|
| 1,439,160 | 12/1922 | Gould | 223/63 |
| 1,667,971 | 5/1928 | Honderville et al. | 223/63 |
| 1,822,281 | 9/1931 | Evanoff | 38/141 X |
| 2,272,051 | 2/1942 | Phelps | 223/65 |
| 2,432,833 | 12/1947 | Tanzer | 223/72 |
| 2,461,381 | 2/1949 | Henderson | 223/63 |
| 2,634,030 | 4/1952 | Hershberger | 223/74 |
| 3,066,839 | 12/1962 | Dosal | 223/70 X |
| 3,221,746 | 12/1965 | Noble | 285/397 X |
| 3,482,744 | 12/1969 | Schlemon | 223/63 |
| 3,491,927 | 1/1970 | Biel | 223/73 |
| 3,726,451 | 4/1973 | Blevens | 223/74 |

*Primary Examiner*—Louis Rimrodt

[57] ABSTRACT

A form for shaping a coat sleeve is a Plexiglass tube with a re-entrant, oval, elongated hoop having a pair of generally straight side portions that generally conform in shape with front and back crease lines of the sleeve. Between the side portions are semi-circular end portions; an end portion proximate the shoulder has a greater radius than the end portion proximate the wrist. The two semi-circular end portions are approximately tangent to the ends of the side portions abutting against them so that there is a smooth transition between each of the side and end portions. Because the tube is Plexiglass, it has spring properties that cause the hoop to return to its original configuration if the hoop is deformed less than the elastic limit of the Plexiglass. The outer edges of the side portions are spaced from each other by more than the separation between the front and back crease lines of the sleeve interior so that the side portions exert outwardly directed forces against the crease lines. The hoop is formed by heating the rod over a rigid mold to provide the rod with an inherent memory of the original molded configuration. The ends of the tube are secured together by a plug having barbs at both of its ends, which barbs project in opposite directions into the interior tube wall to hold the plug and the ends of the tube in situ.

1 Claim, 5 Drawing Figures

COAT SLEEVE FORM

FIELD OF THE INVENTION

The present invention relates generally to a form for shaping a coat sleeve, and more particularly to a coat sleeve form comprised of a rod configured as a re-entrant oval, elongated, hoop of a spring-type material that causes the hoop to return to its original form, and including side portions that are spaced from each other by more than the separation between interior front and back crease lines of a sleeve in which the form is inserted.

BACKGROUND OF THE INVENTION

Numerous structures have been developed to form and shape coat sleeves, such as utilized on men's jackets. The forms are utilized for display purposes, to assist in removing wrinkles after dry cleaning or manufacture, as well as to prevent sagging and folds while a jacket is stored. The prior art devices, however, have generally been complex, including multiple parts or intricate shapes, such as disclosed in U.S. Pat. Nos.: to Tanzer, 2,432,833 on Dec. 16, 1947; Schlemon, 3,482,744 on Dec. 9, 1969; Amber, 2,662,672 on Dec. 15, 1963; Caldwell, 2,485,257 on Oct. 18, 1949.

The Tanzer structure is characterized by a very intricate shape, including interior and exterior portions that are curved at the shoulder and which are joined together by straight segments at the wrist end of the form. Relatively straight side portions on the exterior segment are urged apart by fabric elements that run the length of the form. The interior segment of the form includes a central portion that is encircled by a fabric sleeve.

Schlemon is directed to a sleeve form configured as a nylon tube having a spring wire inserted therein and which includes a bent portion proximate the shoulder. Two springlike arms having open ends extend from the bent portion to a region proximate the wrist end of the sleeve.

The sleeve form disclosed by Caldwell includes a pair of relatively straight arms or bars formed of rigid material. Each of the arms is secured for a substantial portion along its length to an individual spring, with each of the springs being connected together at their ends. One end of one of the bars is connected to an end of the other bar by a metal, shoulder forming portion. The remaining ends of the bars are opened and are adapted to be grasped as the form is inserted into a sleeve.

Amber discloses a sleeve form including a pair of arm members having a general configuration coinciding with the lines of the creases of the garment into which the form is to be inserted. The arm members are connected to each other by springs that are secured to central portions of the arm members and which are joined to each other at their ends.

From the foregoing, it is evident that the prior art sleeve forms have been relatively expensive and complicated structures which are not likely to receive wide acceptance by the general public, and in certain instances, not by merchandisers of jackets and the like.

OBJECTS AND BRIEF DESCRIPTION OF THE INVENTION

It is accordingly an object of the present invention to provide a new and improved sleeve form.

Another object of the invention is to provide a sleeve form that is relatively inexpensive because it is essentially manufactured from a single rod of inexpensive material that is easily formed into an appropriate shape.

In accordance with the invention, a form for shaping a coat sleeve having a predetermined size comprises a rod configured as a re-entrant, oval, elongated hoop having a pair of generally straight, side portions between curved end portions. The side portions generally conform in shape with front and back crease lines of the sleeve. The rod is formed of a spring type material, preferably heat treated, molded methyl methacrylate (Plexiglass) that causes the hoop to return to the configuration after the hoop has been deformed less than the elastic limit of the rod. The hoop form is such that outer edges of the side portions are spaced from each other by more than the separation between front and back crease lines of the sleeve interior so that the side portions exert outwardly directed forces against the crease lines. Preferably, the rod is hollow to form a tube having ends secured together by a plug held in situ against the interior wall of the tube. The plug includes barbs projecting in opposite directions into the interior wall of the tube to hold the plug in situ at opposite ends of the tube. The barbs have an extent into the tube so that they do extend beyond the exterior wall of the tube to avoid the possibility of damaging the coat into which the form is inserted. It is thus apparent that the only spring force urging the hoop form against the sleeve are the internal forces of the spring, whereby no other springs are needed and cost is very low. The internal spring force of the rod is thus the only spring force on the rod which causes the hoop to have its initial configuration and causes the side portions to exert the outwardly directed forces when inserted into the sleeve.

The end portions are approximately semicircular and are respectively proximate the shoulder and the wrist ends of the sleeve while the form is inserted into the sleeve. The end portion proximate the shoulder has a greater radius than the end portion proximate the wrist end and the ends of the two semicircular end portions are approximately tangent to the ends of the side portions abutting against them so that there is a smooth transition between each of said side and end portions. The hoop strength of the semicircular end portions causes the end portions to be relatively inflexible so that there is a restoring force applied by the end portions against the side portions to urge the side portions outwardly.

A further object of the invention is to provide a coat sleeve form configured as a rod with a re-entrant, oval, elongated hoop fabricated of a relatively inexpensive spring type material that inherently has a memory to cause the hoop to return to its initial configuration after having been deformed.

Another object of the invention is to provide a new and improved sleeve form wherein there is a joining of the ends of a plastic tube that is configured as a re-entrant, oval, elongated hoop having a pair of generally straight side portions and curved end portions.

The above and still further objects, features and advantages of the present invention will become apparent upon consideration of the following detailed description of one specific embodiment thereof, especially when taken in conjunction with the accompanying drawing.

DETAILED DESCRIPTION OF THE DRAWING

Figure 1:
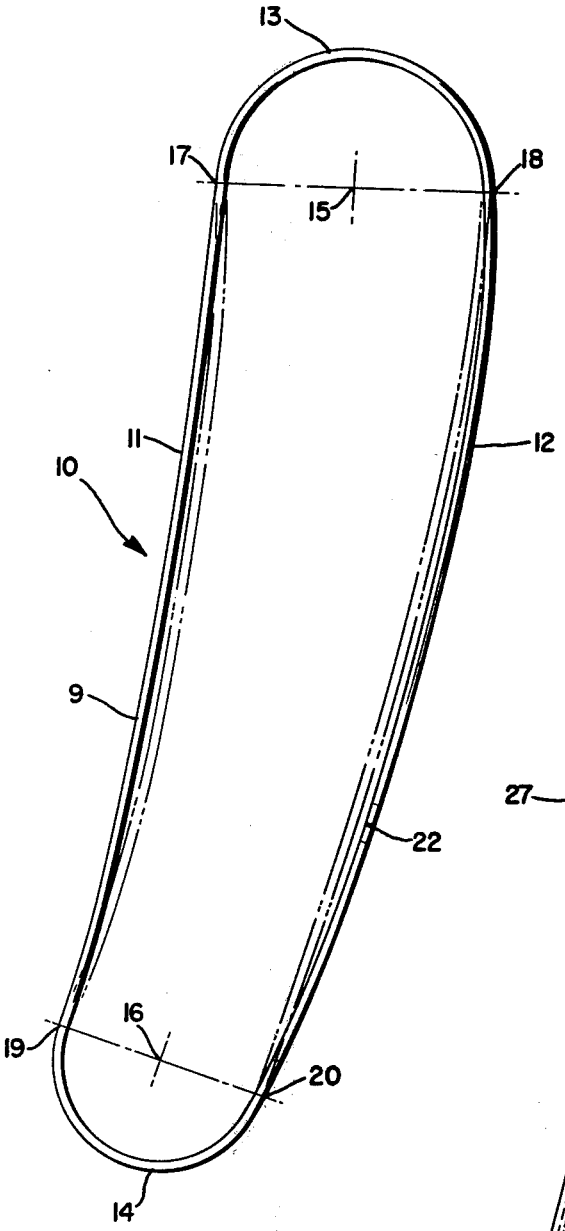
FIG. 1 is a plan view of the sleeve form in accordance with a preferred embodiment of the invention.

Reference is now made to FIG. 1 of the drawing wherein there is illustrated a sleeve form in accordance with a preferred embodiment of the invention. The sleeve form is a hollow tube 9 of heat treated, extruded lucite acrylic tube, preferably DuPont methyl acrylate, frequently known as Plexiglass. Tube 9 is configured as a re-entrant, oval elongated hoop 10 having a pair of generally straight and parallel side portions 11 and 12 between generally curved end portions 13 and 14. Side portions 11 and 12 generally conform in shape with front and back crease lines of a sleeve into which hoop 10 is to be inserted. The Plexiglass rod is heat treated whereby it inherently has a memory and the rod possesses spring-like properties that cause the hoop to return to the configuration illustrated in FIG. 1 after the hoop has been deformed less than the elastic limit of the rod. Side portions 11 and 12 are spaced from each other, virtually throughout their length, by more than the separation between the front and back crease lines of the interior of the sleeve into which the form is to be inserted. Thereby, side portions 11 and 12 exert outwardly directed forces against the front and back crease lines while the form is inserted in the sleeve between the crease lines.

Figure 5:
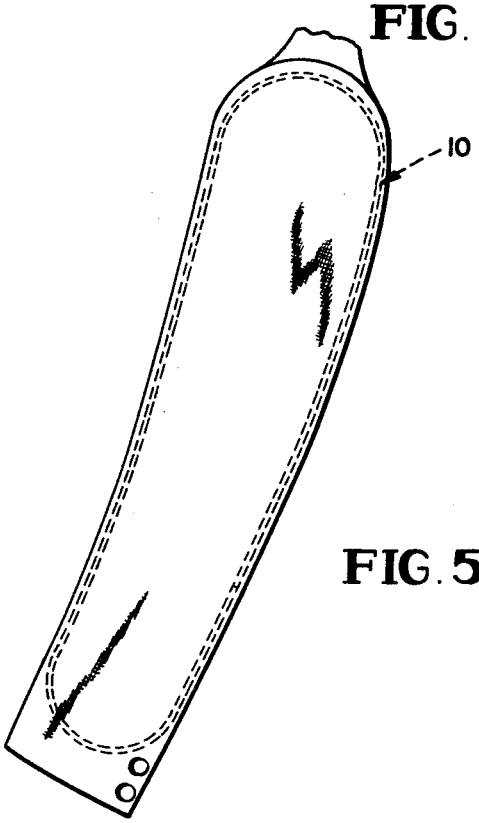
FIG. 5 is a view illustrating how the hoop of the present invention interacts with a sleeve to prevent sleeve wrinkling and to smooth the sleeve.

As illustrated in FIG. 5, end portions 13 and 14 are respectively proximate the shoulder and wrist ends of the sleeve into which the form is inserted. End portions 13 and 14 are semicircular in shape, having centers at points 15 and 16, with the radius of shoulder end portion 13 being greater than the radius of wrist end portion 14. The lower ends of semicircular portion 13 are tangent to the upper ends of side portions 11 and 12, at intersection points 17 and 18. Similarly, the upper ends of end portion 14 are tangent to the lower ends of side portions 11 and 12, at intersection points 19 and 20. Because of the tangency relationship between the ends of portions 11–14, there is a smooth transition between each of the side and end portions.

The sleeve form illustrated in FIG. 1 is inserted into a sleeve of a coat in the same manner as an arm is inserted into a sleeve, whereby wrist end portion 14 is initially inserted into the shoulder hole of the coat. As hoop 10 is pushed down into the sleeve, side portions 11 and 12 become slightly compressed because of: (1) the spacing between the side portions relative to the separation between the interior front and back crease lines of the sleeve, (2) the continuous, re-entrant, oval shape of hoop 10, (3) the spring action of the Plexiglass, and (4) the tendency of end portions 13 and 14 to retain their semicircular shape (due to hoop strength) when the form is inserted into the sleeve.

The shape of hoop 10 when it is inserted into the sleeve relative to its original shape, prior to insertion, is illustrated by dotted lines in FIG. 1. The compression of side portions 11 and 12 causes them to exert a continuous, even force along the front and rear crease lines of the sleeve to achieve the desired result of maintaining a smooth, wrinkle-free pressed appearance until the coat containing the sleeve is worn. A constant force is exerted along the entire front and rear crease lines because of a taper between side portions 11 and 12 resulting from shoulder end portions 13 having a larger diameter than wrist end portion 14. The relative diameters of end portions 13 and 14 enable easy insertion of wrist end portion 14 into the sleeve through the shoulder hole of the coat. Because side portions 11 and 12 of hoop 10 are compressed while the hoop is in place within the sleeve, there is the inherent spring action of the side portions against the front and rear crease lines of the sleeve.

A straight, Plexiglass tube 9 is bent into the shape of hoop 10 by heating the tube and bending it over a rigid mold having the same configuration as the hoop. Tube 9, after being bent into the shape of hoop 10 over the mold, is allowed to cool and has the shape generally illustrated in FIG. 1 after removal from the mold.

Figure 2:
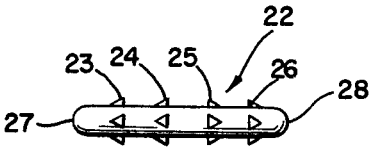
FIG. 2 is a plan view of a plug utilized for securing the ends of the rod illustrated in FIG. 1 together.
Figure 3:
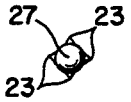
FIG. 3 is an end view of the plug illustrated in FIG. 2.
Figure 4:
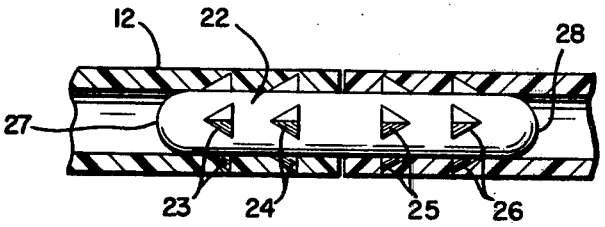
FIG. 4 is a side sectional view of the plug and a tube utilized in the former of FIG. 1.

The two open ends of tube 9 are then permanently joined by inserting a drive lock or plug 22 into the two open ends. Plug 22, FIG. 2, is an elongated, cylindrical, aluminum stud having four sets 23–26 of longitudinally positioned, radially extending barbs. At each longitudinal position of plug 22, four sets of barbs are provided at mutually orthogonal angles about the center of the plug. The barbs adjacent each end of plug 22 include smooth tapering portions proximate the adjacent end of the plug; the smooth portions intersect with radially extending portions of the barbs to form pointed tips that project into the interior of tube 9. Hence, the barbs included in sets 23 and 24 have smooth transitions relative to end 27 of plug 22, while the barbs included in sets 25 and 26 have smooth transitions in the opposite direction, away from end 28 of plug 22. The barbs in sets 23–26 project into the interior wall of tube 9, in a manner similar to a fish hook, and have a radial extent slightly less than the thickness of the tube 9 forming hoop 10, as illustrated in FIG. 4, so that the barbs do not extend behond the tube exterior wall into the sleeve material. The diameter of plug 22 is approximately equal to, but slightly less than, the inner diameter of tube 9 so that the plug can be readily inserted into the tube. It has been found that plural sets of barbs on each side of the center line of plug 22 enhances the ability of the barb to hold the ends of tube 9 securely in situ.

There is a substantial separation along the length of plug 22 between adjacent, oppositely directed barbs of sets 24 and 25. Thereby, the effective length and configuration of hoop 10 can be varied slightly for sleeves having different dimensions by controlling the separation between the ends of rud 9 on plug 22. For smaller sleeves, the ends of rod 9 can be in abutting relationship on plug 22, while for slightly larger sleeves, the ends of the rod can be separated from each other, in close proximity to the barbs of sets 24 and 25. This control can be utilized for slight variations in sleeve sizes. For larges variations in sleeve size, it is necessary to employ rods and forming molds having different dimensions, but the same configuration as illustrated.

In one preferred embodiment, the Plexiglass tube has an inner diameter of 3/16 inch, an outer diameter of 5/16 inch, and a wall thickness of $\frac{1}{4}$ inch. Plug 22 has a length of $1\frac{1}{4}$ inches, a plug diameter of 3/16 inch, and a barb extension of 1/16 inch. It was found that these dimensions and the Plexiglass structure provide the desired results of an inexpensive coat sleeve form that enables the sleeve to maintain a pressed appearance between usages of the coat, by eliminating wrinkles. It was found that the form freshens the appearance of packaged coats overnight and that sleeves of coats placed in traveling clothing bags do not have wrinkles if the form of the present invention is utilized.

While there has been described and illustrated one specific embodiment of the invention, it will be clear that variations in the details of the embodiment specifically illustrated and described may be made without departing from the true spirit and scope of the invention as defined in the appended claims.

What is claimed is:

1. A form for shaping a coat sleeve having a predetermined size, said form being capable of being utilized for display purposes, to assist in removing and preventing wrinkles and to prevent sagging and folds of the sleeve during storing, comprising a rod configured as a reentrant, oval, elongated hoop having a pair of generally straight, side portions between curved end portions, the side portions generally conforming in shape with front and back crease lines of the sleeve, the rod having a memory and being of a spring type material that exclusively exerts a spring force on the rod, the memory and spring force causing the hoop to return to the configuration after the hoop having been deformed less than the elastic limit of the rod, the rod being heat treated methyl methacrylate molded to the configuration so that ends of the rod are secured together, the hoop form being such that outer edges of said side portions are spaced from each other by more than separation between front and back crease lines of the sleeve interior so that the spring force of the rod causes the side portions to exert outwardly directed forces against the crease lines while the form is inserted in the sleeve between the crease lines, end portions of the hoop being approximately semicircular and respectively proximate the shoulder and wrist ends of the sleeve while the form is inserted into the sleeve, the end portion proximate the shoulder having a greater radius than the end portion proximate the wrist end, the ends of the two semicircular end portions being approximately tangent to the ends of the side portions abutting against them so that there is a smooth transition between each of said side and end portions, said rod being hollow to form a tube, the ends of the tube being secured together by a plug held in situ against the interior wall of the tube, said plug including barbs at both of its ends, the barbs at the different ends projecting in opposite directions into the interior wall of the tube to hold the plug in situ, said barbs having an extent into the tube so that they do not extend beyond the exterior wall of the tube, plural sets of barbs being provided on at least one of the plug ends at differing longitudinal positions of the plug, a substantial separation being provided along the length of the plug between adjacent, oppositely directed barbs so that the dimensions of the hoop can be controlled as the plug is inserted into the tube and rods of the same length can be used for sleeves of differing dimensions.

* * * * *